US007817907B2

(12) United States Patent
Yui

(10) Patent No.: US 7,817,907 B2
(45) Date of Patent: Oct. 19, 2010

(54) WATER HEATING VESSEL

(76) Inventor: George Yui, 260 Scarlett Rd., Apt 2013, Toranto, ON (CA) M6N 4X6

( * ) Notice: Subject to any disclaimer, the term of this patent is extended or adjusted under 35 U.S.C. 154(b) by 620 days.

(21) Appl. No.: 11/853,796

(22) Filed: Sep. 11, 2007

(65) Prior Publication Data

US 2008/0050105 A1 Feb. 28, 2008

Related U.S. Application Data

(63) Continuation-in-part of application No. 10/794,711, filed on Mar. 5, 2004, now abandoned.

(51) Int. Cl.
*H24H 1/18* (2006.01)
*H05B 3/60* (2006.01)

(52) U.S. Cl. ..... 392/450; 450/322

(58) Field of Classification Search ..... 392/450, 392/311–464; 220/500–557; 222/67–69; 422/7

See application file for complete search history.

(56) References Cited

U.S. PATENT DOCUMENTS 3,962,560 A * 6/1976 Braathen ..... 392/456
4,598,694 A * 7/1986 Cromer ..... 122/19.1
4,614,859 A * 9/1986 Beckering et al. ..... 392/444
4,632,065 A * 12/1986 Kale ..... 122/19.1
4,634,838 A * 1/1987 Berz ..... 392/445
5,898,818 A * 4/1999 Chen ..... 392/449
6,243,535 B1 * 6/2001 Bochud ..... 392/459
6,898,374 B1 * 5/2005 Wen ..... 392/459
6,907,923 B2 * 6/2005 Sienel ..... 165/236

* cited by examiner

*Primary Examiner*—Daniel Robinson
(74) *Attorney, Agent, or Firm*—Michael Ries

(57) ABSTRACT

A tank for retaining and heating water is defined by tank walls, including a bottom wall portion comprised of stainless steel. The tank has a water inlet and a water outlet for dispensing hot water. An aluminum intermediate plate is brazed to the lower surface of the bottom wall portion. A heating element secured within a heat conductive sheath, is brazed to the intermediate plate. A baffle is positioned within the walls of the tank, dividing the tank into an upper water reservoir and a lower preheating chamber, the baffle having at least one open portion defined therethrough.

21 Claims, 11 Drawing Sheets

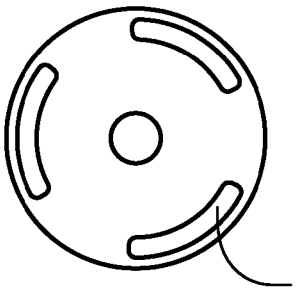
FIG. 11A
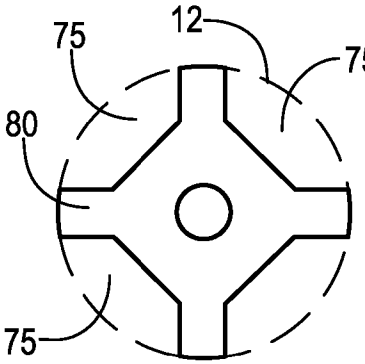
FIG. 11B
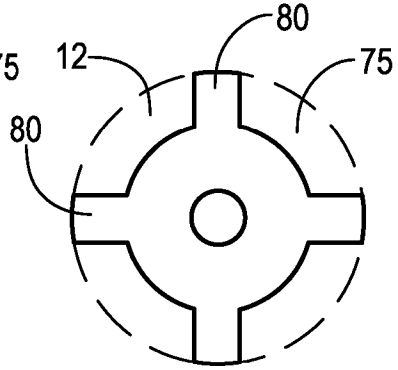
FIG. 11C
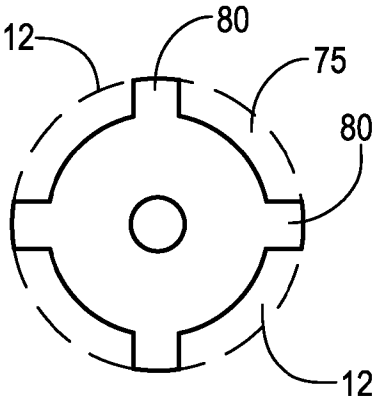
FIG. 11D
FIG. 11E
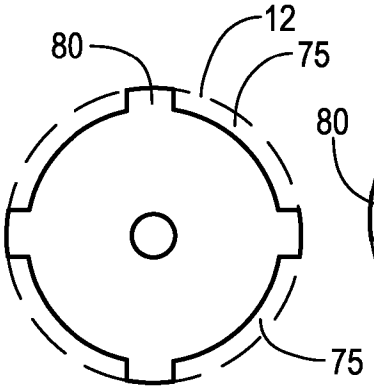
FIG. 11F
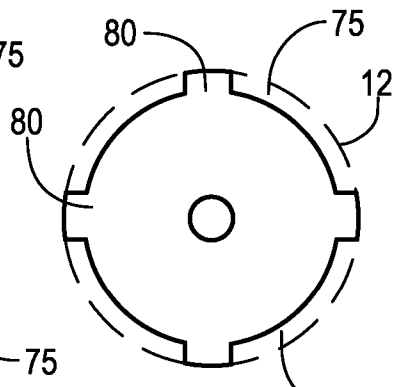
FIG. 11G
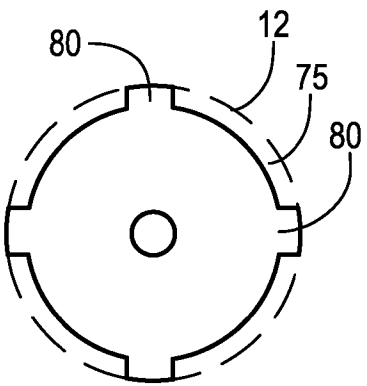
FIG. 11H

WATER HEATING VESSEL

This application claims priority to U.S. Utility application Ser. No. 10/794,711 filed Mar. 5, 2004, the entire disclosure of which is incorporated by reference.

FIELD OF THE INVENTION

The present invention relates to hot water dispensing tanks.

BACKGROUND OF THE INVENTION

It is known to provide water tanks which are designed to heat and dispense water for various purposes such as for hot beverages and the like. It is desirable to ensure that a sufficient volume of water is heated quickly, quietly and efficiently for dispensing. In one type of known heating tank for dispensing hot water, water is supplied to the tank through an inlet pipe and a heating collar is secured around the tank. The collar with heating element therein, transfers heat through to the water within the tank via heat conductive walls of the tank. In such types of hot water tanks, it is difficult to avoid clearance between the heating collar and tank outer wall, which therefore does not allow for maximal conduction of heat through to the water and which may tend to cause noise as the heating element, typically a standard electrical heating element, is powered. Furthermore such collar type heaters take up a considerable amount of space around the periphery of the tank.

In order to increase speed and efficiency of heating of the water it is known to provide a heating element positioned within the water vessel for immersion directly in the water. The heating element of this type of heating system may be exposed to impurities within the water and requires a significant amount of degree of cleaning and maintenance.

It is also known to provide a resistive type heating element mounted adjacent the bottom wall of the water tank for heating the contents of the tank. In order to improve transfer of heat to the tank, the heating element, contained within heat conductive material, such as aluminum, is itself affixed to the tank. As the element is electrified, heat is transferred through to the water in the tank via heat conductive tank bottom wall. Such heating apparatus may not optimally transfer heat to the water within the tank due to clearance between the element and the tank wall. Furthermore, a certain degree of noise as the heat element is activated is commonly observed.

Typical hot water tanks have one large compartment inside with the water in the compartment heated from outside of the tank. Due to convection principles, cold water introduced into the tank tends to fall to the bottom during the introduction of water into the tank with hot water rising to the top. Known tanks for dispensing hot water tend not to heat water as rapidly and/or as efficiently as is desired.

In order to disperse cold water as it enters into the tank and to reduce temperature differentials within the tank, it is known to provide a cold water baffle adjacent to the entry point for cold water, such as is shown in FIG. 14 which is shaped to disperse cold water as it enters the tank. The shape and orientation of known baffles does not lend itself to maximal dispersion of cold water and thereby for the most efficient heating of water. Furthermore, known hot water tanks in the coolers have separate intake, drain and outlet pipes for the incoming cold water, outgoing hot water and for draining the pipe.

SUMMARY OF THE INVENTION

It is an object of the present invention to overcome, inter alia, the shortcomings of the prior art described above by providing an improved water heating tank.

According to one aspect of the invention, there is provided an apparatus for retaining and heating water comprising a tank for retaining water, said tank defined by heat conductive tank walls, including a bottom wall portion comprised of heat conductive material, the tank having a water inlet port for receiving water and a water outlet for dispensing hot water. An intermediate plate comprises heat conductive material and is brazed to the lower surface of said bottom wall portion. A heating element is secured within a heat conductive sheath, said sheath brazed to and positioned below the intermediate plate for provision of heat thereto and thus to the water retained in said tank.

In accordance with a further aspect of the invention there is provided an apparatus for retaining and heating water comprising a tank for retaining water, said tank defined by heat conductive tank walls including a bottom wall portion; a baffle positioned within the walls of the tank, extending across the interior of the tank dividing the tank into an upper water reservoir and a lower preheating chamber, said baffle defining at least one open portion there through to allow water to flow between the preheat chamber and the water reservoir; and a heater secured to the lower surface of the bottom wall portion for providing heat to the water in the preheat chamber. Preferably the tank includes an inlet which delivers water into the preheat chamber and an outlet positioned at an upper portion of the tank for dispensing of hot water there from.

In accordance with a further aspect of the invention provided is a thermostat including temperature sensing means with the thermostat positioned on the side wall of the tank, and which activates the heating element to provide heat to the tank when the thermostat reads a temperature at or below a preset temperature, the thermostat positioned on the tank wall below the midway point between the top and bottom wall of the tank and where a baffle is present in the tank, below the position of the baffle.

In accordance with a further aspect of the invention, a hot water tank utilizes a dual purpose water inlet pipe/drain pipe comprising a drain/intake pipe portion extending through the bottom of a tank. A t-connector connects the common drain/intake pipe portion to a vertically extending intake pipe and a horizontally extending drain pipe. The intake pipe is connected to a cold water source positioned above the heater tank, the intake pipe being adapted for connection to the intake fitting of the cold water source. The t-connector connects the common drain intake pipe to a drain pipe having a drain fitting at the end thereof. Water may be drained through the drain pipe when water from the inlet source is shut off. This way heat is not wasted and is not transmitted to the cold water tank, since the drain pipe is observed to be the lowest temperature pipe in the system.

The brazing of the heating element embedded in a heat conductive material to the intermediate heat plate and the intermediate plate to the tank walls increases the surface area and the thermal conductivity of the junction between the heat element and heating plate and tank walls thereby improving efficiency of heat transfer.

The presence of a baffle within the tank creates a preheat chamber which allows more rapid heating of the incoming water before it mixes together with the rest of the water in the tank. The baffle includes at least one open portion defined there through which is preferably positioned around the perimeter of the baffle and covers in the range of 5% to 70% of the cross sectional area of the tank (ie. the surface area of the baffle if it completely separated the chambers).

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

A preferred embodiment of the invention will now be described, by way of example, with reference to the accompanying drawings, in which:

FIGS. 11A-11I are top section views of various embodiments of baffles in position within a tank in accordance with the invention;

DETAILED DESCRIPTION OF THE PREFERRED EMBODIMENTS

Figure 1:
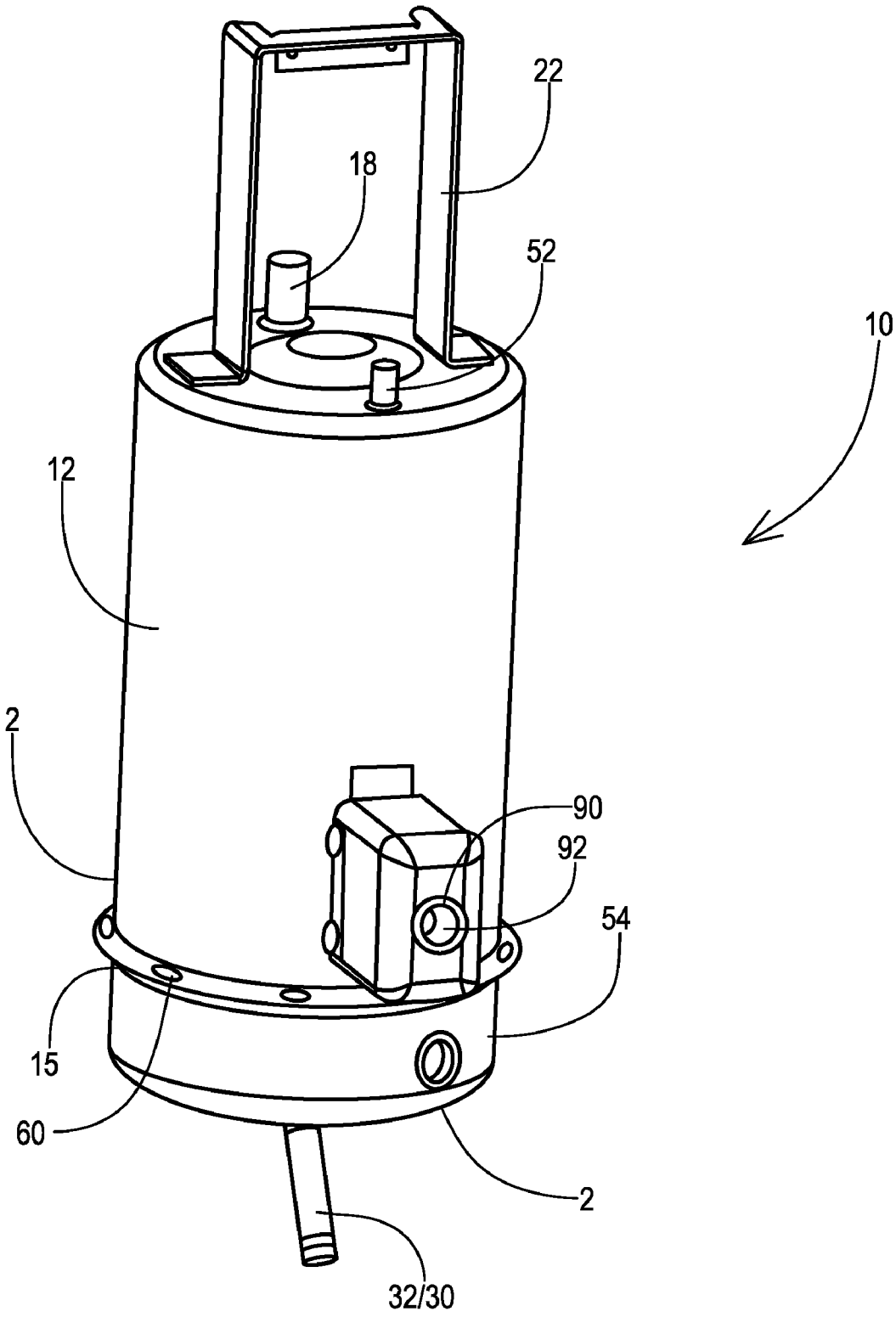
FIG. 1 is a perspective view of a preferred embodiment of the water tank of the invention.
Figure 2:
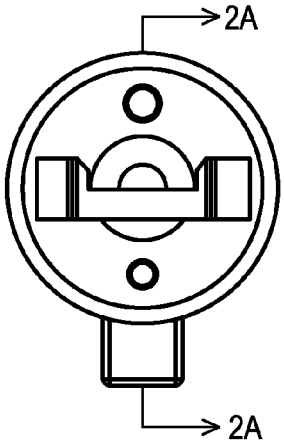
FIG. 2 is a sectioned view of the embodiment of the water tank of FIG. 1 taken along line 2-2 of FIG. 1.
Figure 2A:
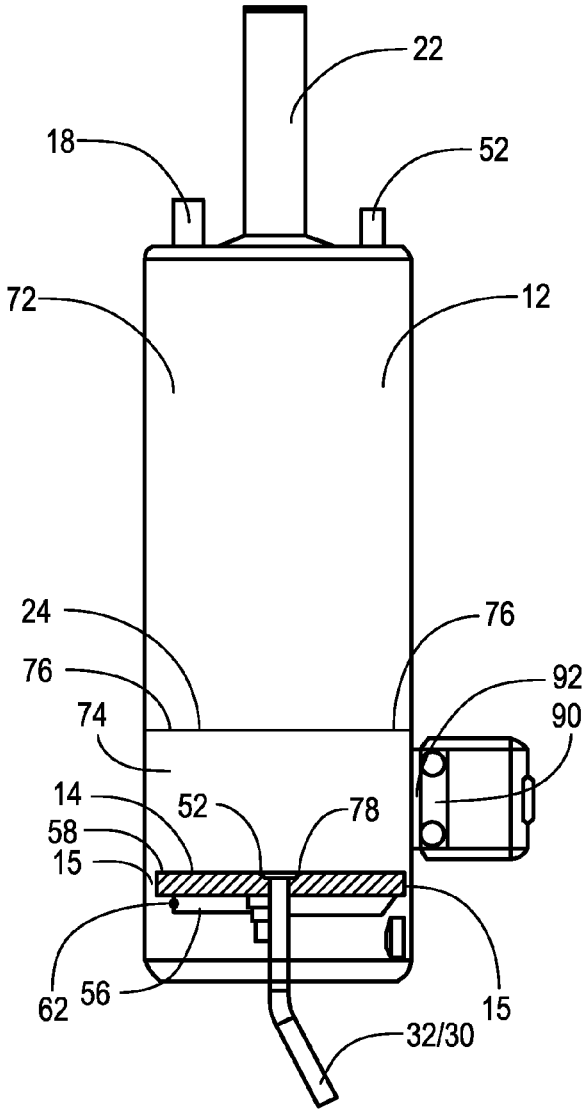

In the description below, like reference numerals are used to indicate components which are similar in the various embodiments of the present invention. Primed reference numerals are used to indicate different variants of the similar components.

Shown in FIGS. 1 to 6, are embodiments of water retaining and dispensing tank 10 having heat conductive tank walls 12, including a separate bottom wall portion 14 which is preferably attached to the side walls in a manner discussed below. It is preferred to use stainless steel as the material for the tank walls as stainless steel has high heat tolerance and is far less reactive with hot liquids than other materials such as aluminum.

Figure 3:
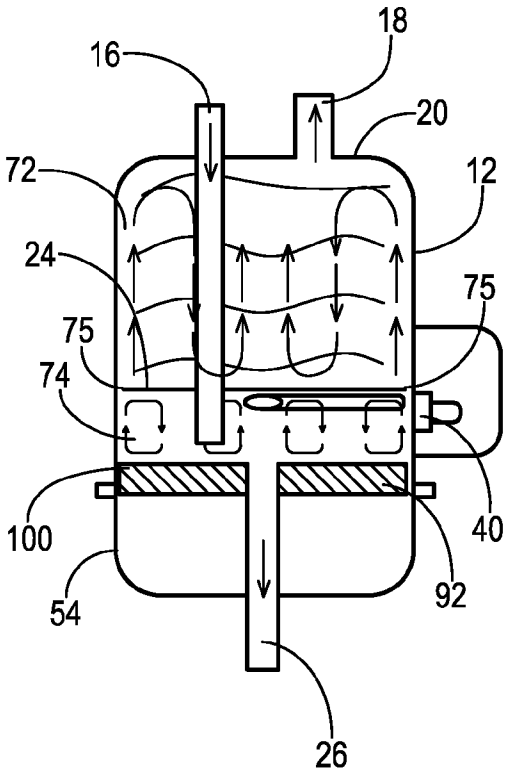
FIG. 3 is a sectioned schematic view of a preferred embodiment of the water tank of the invention showing flow pattern of water within the tank.

In the embodiment shown in FIG. 3, the tank includes a water inlet port 16 for receiving water, and a water outlet 18 for dispensing hot water. The water inlet 16 guides water into the body of the tank from a cold water source such as a cold water tank (not shown), and the water outlet tube 18 guides the water out of tank to any suitable dispensing apparatus (not shown).

The follows sets out a preferred construction of a tank. It should be understood, however, that any suitable shape and construction of a tank may be utilized and any suitable heat conductive material may be utilized to form the walls of the tank. Preferably the tank is formed with tank walls constructed of stainless steel. One preferred tank; has a capacity of 1.5 liters. The tank is formed of a side wall 12 and upper wall portion 20. A bottom wall portion 14 having a peripheral lip 15 is welded to the lower periphery of the side wall 12. The bottom wall portion 14 is made from stainless steel (preferably 304 grade). This bottom wall portion is formed by stamping and pressing on a standard metal stamping press in a known manner. A mounting bracket 22 is secured upon the upper wall 20 of the tank adapted to secure the tank in a tank holding apparatus.

As can be seen in FIG. 3, the water inlet may be an inlet pipe 16 which extends into the tank through the top of the tank, and where applicable through the baffle 24, which delivers water within the tank at or near the bottom wall 14 of the tank. Alternately, shown in FIG. 5, the inlet pipe 16 may enter the tank through the side wall for delivery of water at or near the bottom of the tank. In an embodiment shown in FIG. 3, a drain hole 28 is defined in the bottom wall of the tank and drain pipe 26 extends from the drain hole for drainage of water there from.

Figure 4:
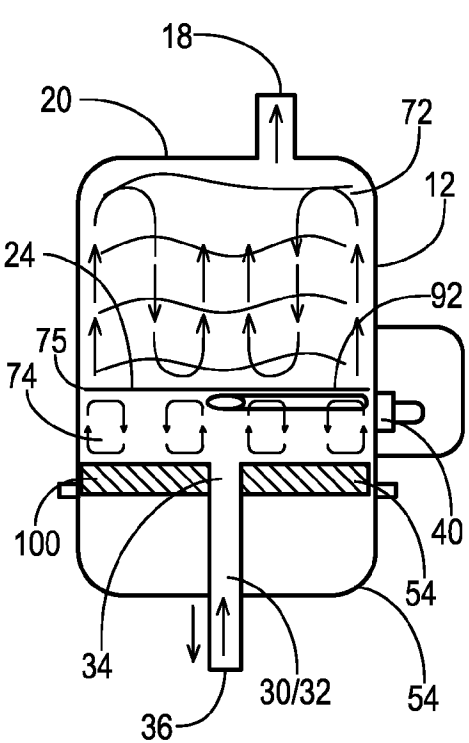
FIG. 4 is a sectioned schematic view of a further embodiment of the water tank of the invention showing flow pattern of water within the tank.
Figure 6:
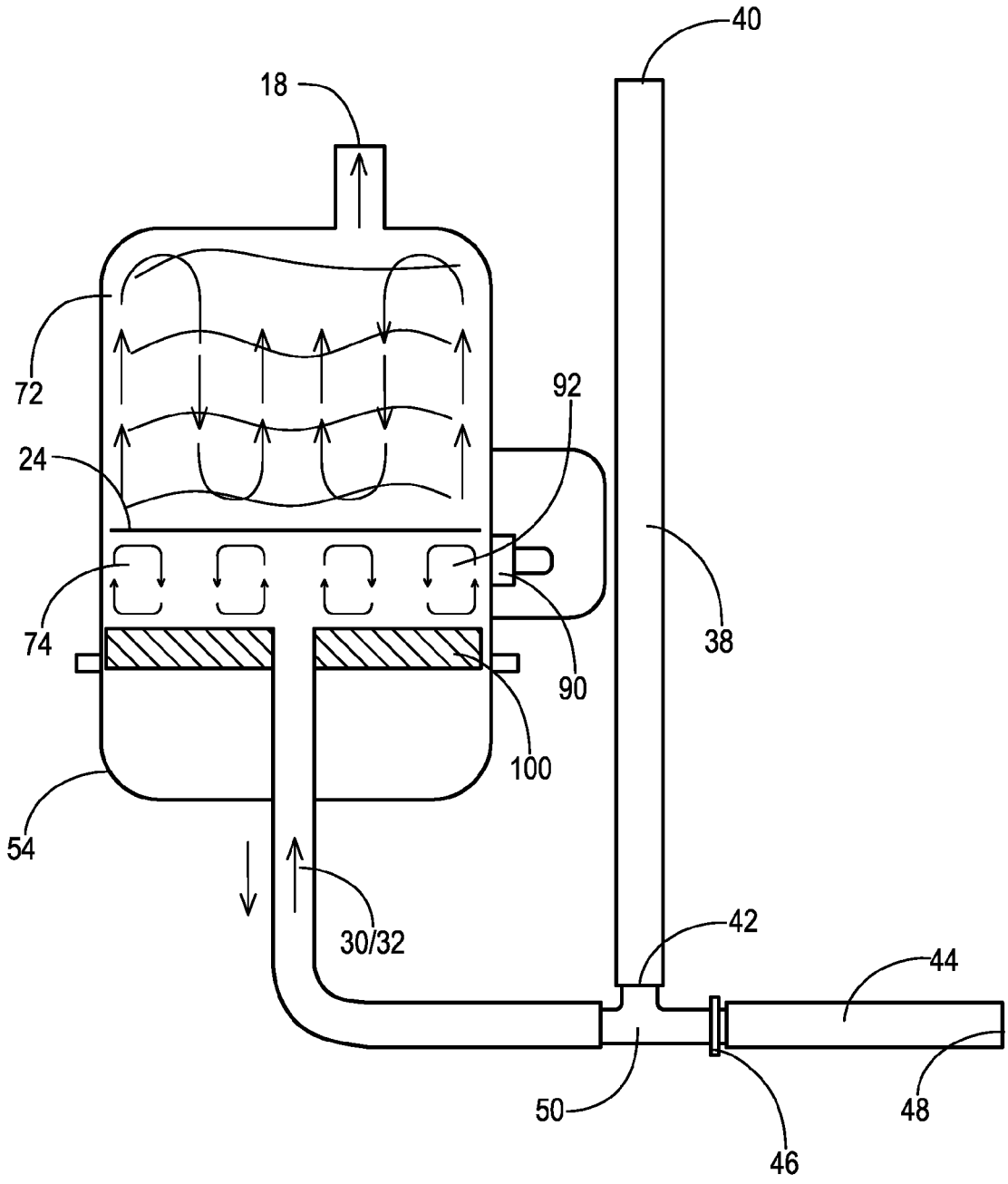
FIG. 6 is a sectioned schematic view corresponding to that of FIG. 4, further illustrating an inlet/drain pipe in accordance with the invention.
Figure 6A:
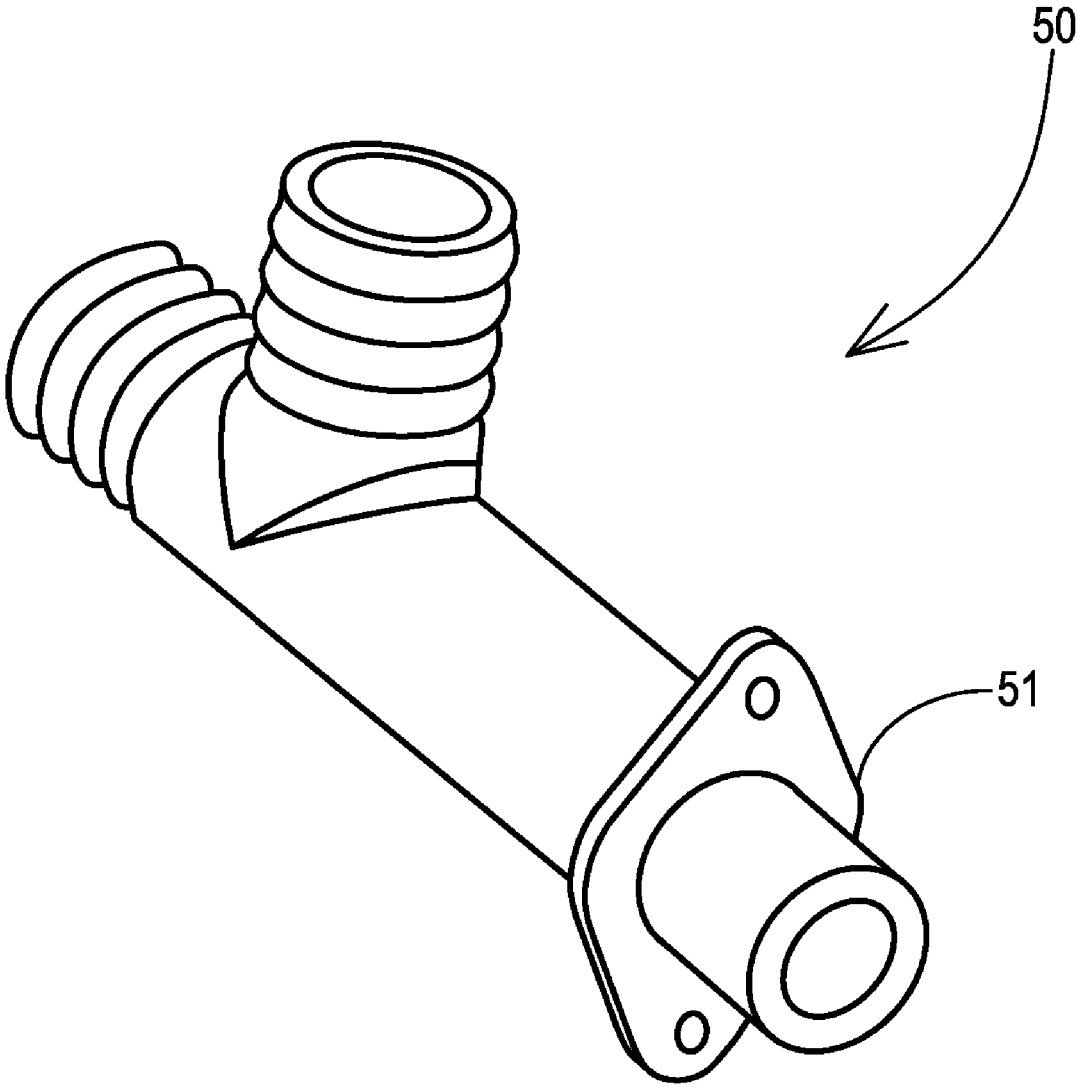
FIG. 6A is a perspective view of a t-connector for an inlet/drain pipe in accordance with the invention.

In one embodiment, shown in FIGS. 4 and 6, a water inlet/drain pipe 30 has a drain/intake pipe portion 32 extending through the bottom portion of the tank walls 14, having an inlet opening 34 into the tank and an outlet opening 36 outside the tank. FIG. 4, shows only a portion of the pipe. In FIG. 6 the pipe is shown in its entirety and has a vertically extending intake pipe 38 having an upper opening 40 and a lower opening 42 and a drain pipe 44 having a proximal opening 46 and a drainage opening 48 at the other end thereof. A t-connector 50 connects the outlet opening of the common drain/intake pipe 32 to the lower opening of the vertically extending intake pipe 42 and to the proximal opening 46 of the drain pipe. The upper opening of the intake pipe 40 is connected to a cold water source for delivery of cold water to the tank via the inlet pipe 38, the t-connector 50 and the drain/intake pipe 32. Water is drainable from the tank through the drain/intake, portion 32, t-connector 50 and drain pipe 44 when water from the cold water source is shut off. By use of this pipe combination, heat is not wasted and is not transmitted to the cold water tank, since the drain pipe is observed to be the lowest temperature pipe in the system. Seen in FIG. 6*a* is an embodiment of t-connector 50. The t connector 50 may include an end 51 over which a closure cap (not shown) may be secured, if desired.

Preferably, the water outlet is positioned at the top of the tank and outlet pipe 18 extends outwardly there from, adapted for attachment to a dispenser (not shown) for dispensing hot beverages. The outlet 18 for water is positioned at the top of the tank so as to take advantage of principles of convection which causes hot water to rise and cold water to fall due to variations in density of the fluid and the action of gravity thereupon, as can be seen by the arrows in FIGS. 3 to 6.

Preferably an air vent 52 is positioned at the top of the tank and a mounting bracket 22 is secured to the upper wall 20 of the tank adapted for securing the tank within a water dispensing apparatus (not shown).

Preferably a cover 54 is secured over heating element 62, sheath 56 and intermediate plate 58, secured at its edges to the bottom perimeter of the tank, where the bottom wall portion meets the side walls of the tank, by spring clips 60. The cover is preferably comprised of stainless steel or cast iron. It should be understood that the cover could be secured by any suitable means to the tank, encasing the heating element 62, sheath 56, intermediate plate 56. As can be seen in the drawings, the cover leaves no exposed contacts.

Figure 7:
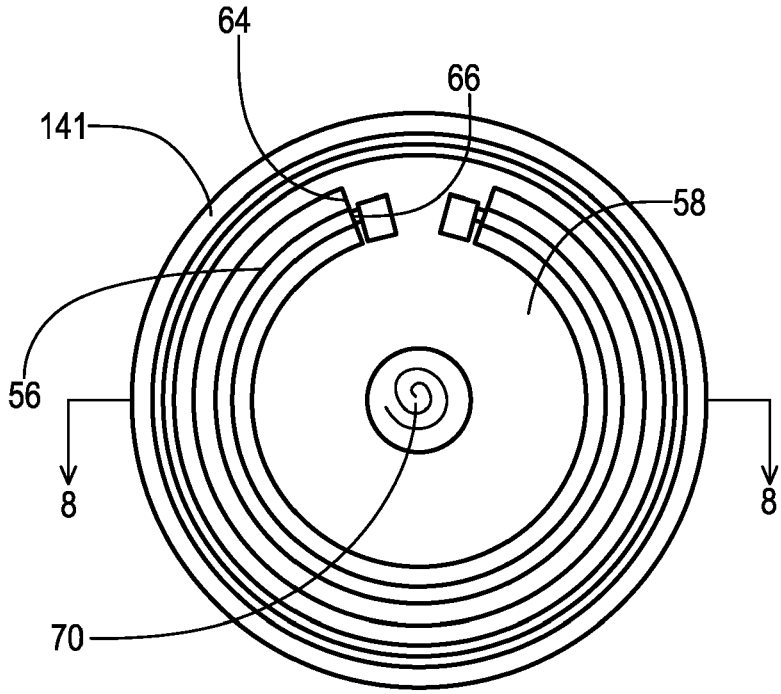
FIG. 7 is a bottom view of the heating element, sheath and intermediate plate secured to the bottom wall of a tank in accordance with the invention.
Figure 8:
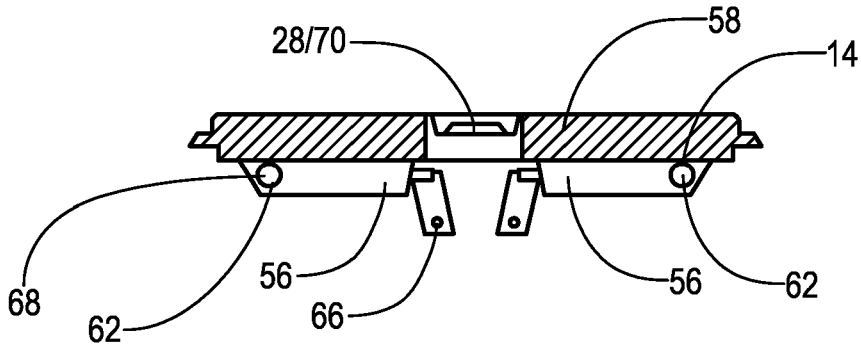
FIG. 8 is a section view taken along line A-A of FIG. 7.
Figure 9:
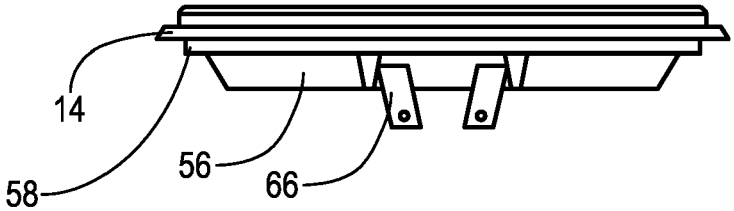
FIG. 9 is a side elevation view of the heating element, sheath, intermediate plate and bottom wall of FIG. 7.
Figure 10:
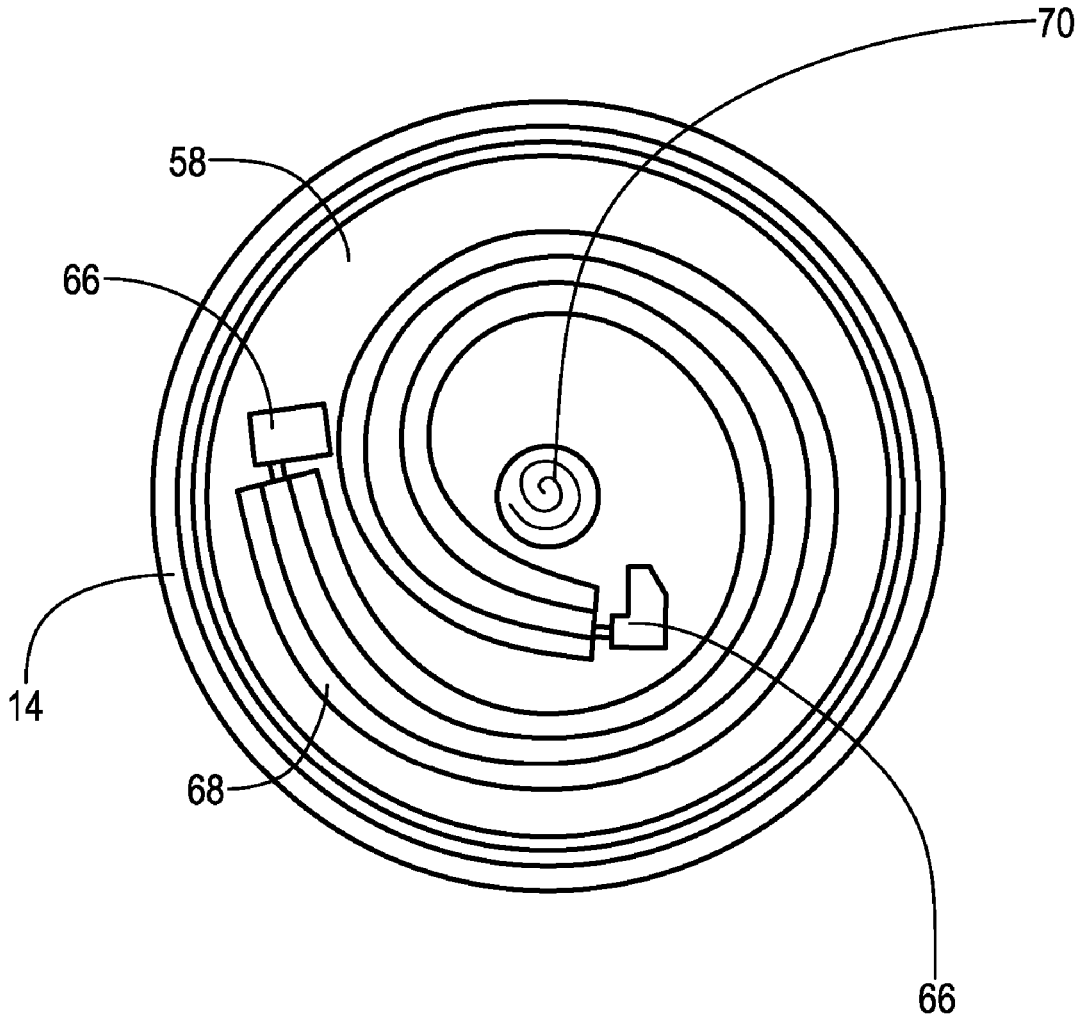
FIG. 10 is a bottom view of an alternate embodiment of a heating element and sheath brazed to an intermediate plate and bottom wall of the tank in accordance with the invention.

Preferably heat is supplied to the water in the tank by means of heating element 62 inserted within heat conductive sheath 56. As shown in FIGS. 7 to 9, the preferred sheath 56 is constructed from aluminum material and measures 226 mm long and has a trapezoidal cross section. It is formed into a circular shape with, sheath diameter of 75 mm. The preferred cross sectional dimensions of the sheath are 9 mm high, 4 mm across at the top and 13 mm across at the base with a wall thickness of 1 mm. The terminal seals 64 at each end of the sheath are constructed of ceramic material rated to withstand 1000 degrees Celsius, filling both ends of the sheath. Terminal pins 66 are comprised of stainless steel, spot welded to the resistance wire, each extending outside the terminal ends of the sheath. The resistance wire is preferably spirally wound in a 3 mm O.D. for 115 V and 3.4 mm O.D. for 230 Volts. The resistance wire 68 is formed from 0.27 mm wire for 115 V and 0.17 mm for the 230 Volts. Preferably wire is made from OCr25Al5 material. Preferably the void within the sheath around the resistance wire is filled with Magnesium oxide powder or silica or any other suitable material. Wire connectors are formed from stainless steel material, spot welded to the terminal pin. Alternately, a further embodiment of the sheath and resistance wire 68 may be formed in a spiral pattern as shown in FIG. 10, which will allow for a lower density heating element. Either configuration of sheath may be utilized with the water tank described below.

Although preferred heating elements are described above, it should be understood that any suitable heating element could be used, and if a sheath is utilized with the heating element, any suitable material for the sheath could be utilized.

The heat conductive intermediate plate 58, is attached to the sheath 56 retaining the heating element 62 by induction or furnace brazing. Preferably the intermediate plate 58 is comprised of pure aluminum and is a cold rolled plate flat without distortions and impurities. It is machined into round circular shape. It has a preferred thickness of 3 to 9 mm. In a preferred embodiment it is 5 mm thick. The plate may include a central aperture 70 to accommodate a drain and/or inlet pipe 26, 30, 32 from the tank.

Preferably the intermediate plate 58 is brazed over its entire surface area to the lower surface of the stainless steel bottom wall portion 14 of the tank and the heating element sheath 56 is brazed to intermediate plate. The preferred process for brazing the bottom wall, intermediate plate and sheath together is as follows: The parts are cleaned; brazing compound/paste applied to the contact faces; parts are positioned with the bottom wall at the bottom, intermediate plate and heater sheath on top. The components are placed inside of the induction brazing machine, clamped and brazed.

Any suitable brazing material known in the art may be used to braze the sheath 56 to the intermediate plate 58 and to braze the intermediate plate 58 to the bottom surface of the tank bottom wall 14. Examples of suitable brazing filler material which may be utilized are Si, Al—Si, Al—Si—Mg, Al—Cu, Al—Zn, Al—Ni compounds or any other suitable brazing materials for use with aluminum and stainless steel known to persons skilled in the art.

The brazing of the sheath 56 in which the heating element 62 is retained to the intermediate aluminum plate 58 and the intermediate plate over its entire surface area to the tank wall 14 increases the surface area and the thermal conductivity of the junction between the heat element and heating plate and tank walls thereby improving efficiency of heat transfer. Aluminum components are known for high heat conductivity and thus preferably the intermediate heating plate is comprised of aluminum. It should be understood that any suitable heat conductive material could be utilized in alternative to aluminum, if desired. For example it could be made of copper, brass, steel or the like. Likewise, the heater sheath could be made from the variety of other materials, like copper, brass, steel, etc. Different materials could be used for each component. For example it is possible to use a stainless steel tank bottom wall, a carbon steel back up plate and copper sheath for heater. All three components, could be brazed together.

It should be understood that other methods of securing the heating element 62 to the intermediate plate 58 and the intermediate plate to the tank walls 14, for example by mechanical means such as using bolts or by soldering, or welding of parts to each other or by means of furnace brazing process. In fact, shown schematically in FIGS. 3 to 6 are heat providing means 100 which could be the heating elements, heating plate, sheath combination described above or any suitable heating means.

Figure 5:
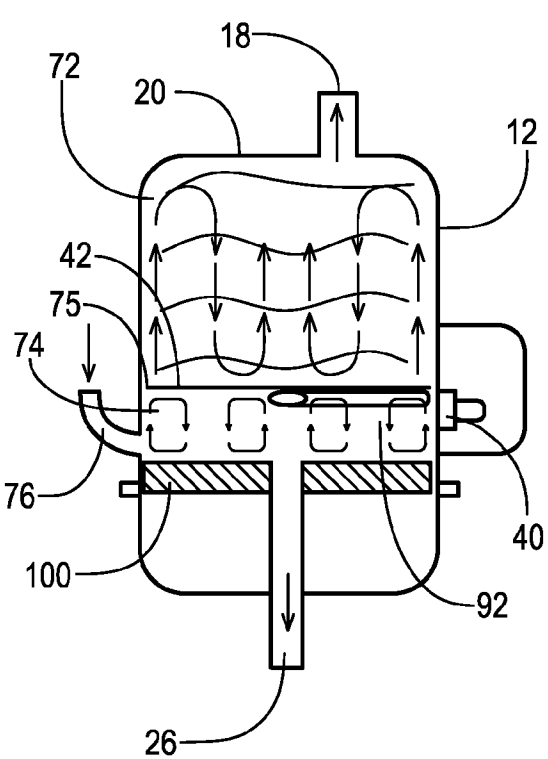
FIG. 5 is a sectioned schematic view of an embodiment of the water tank of the invention showing flow pattern of water within the tank.
Figure 11I:
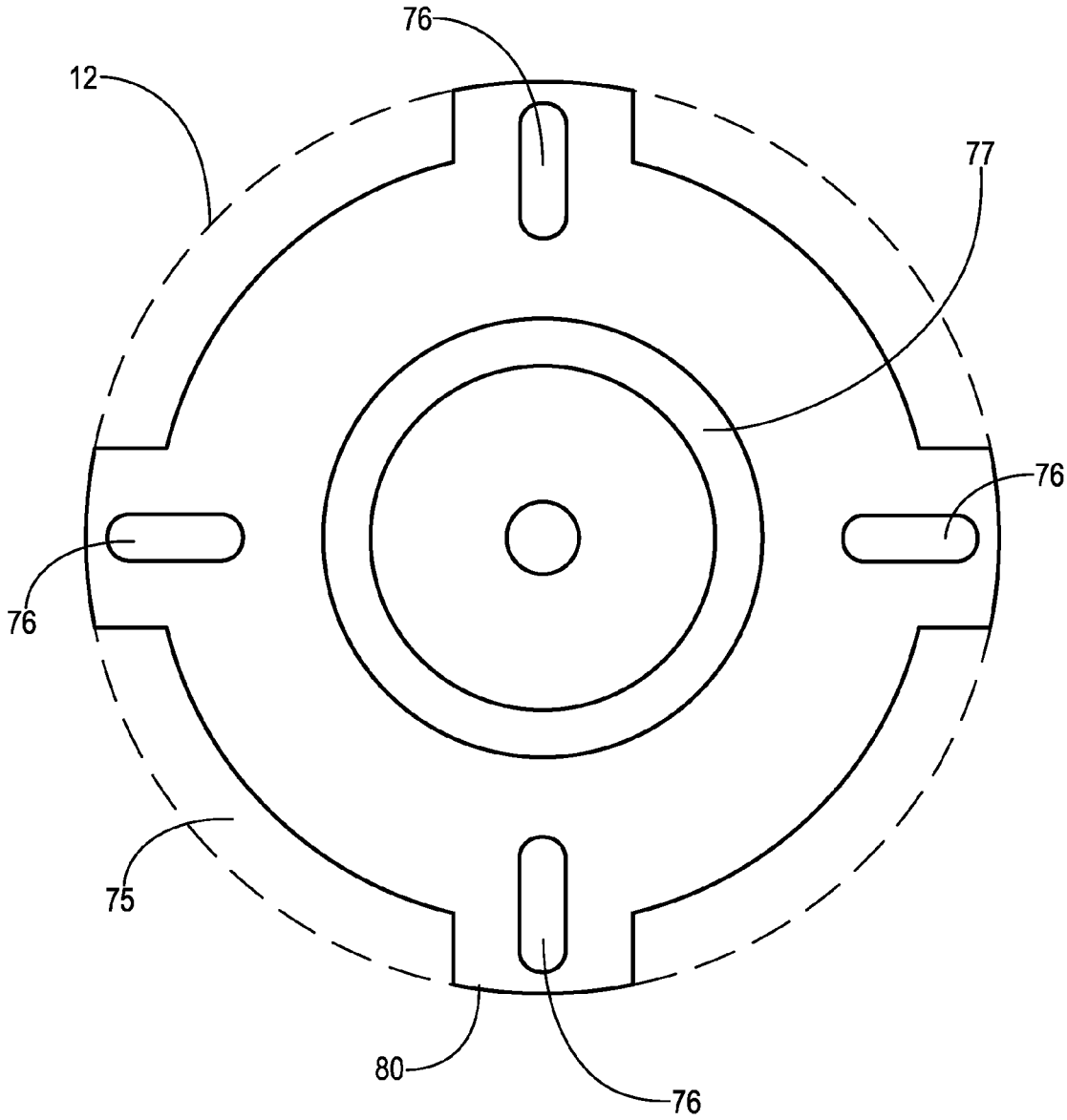

As seen in FIGS. 2 to 6, a baffle 24 is positioned within the tank, extending across the interior of the tank and creates an upper water reservoir 72 and a lower preheating chamber 74 within the tank. Preferably, the baffle is positioned approximately ⅕ of the way up from the bottom wall of the tank. Water inlet pipe 16 or 16' delivers water into the preheat chamber. The baffle 24 defines at least one open portion 75 which allows the flow of water between the preheat chamber and the upper reservoir. These open portions may be a plurality of regularly spaced orifices, being either circular 76 or slot shaped 76' as illustrated in FIG. 11A, 11E or 11I or any other suitable shape. Alternately, as shown in FIGS. 11S, 11C, 11D, 11F, 11G and 11H, the open portions 75 may be formed around the periphery of the baffle, being formed between the legs 80 of the baffle, the open portions 75 forming a gap between the baffle and the tank wall 12 and allow water to flow up the periphery of the tank wall through the open portions when the baffle 24 is secured in place within the tank with the legs pressed against the tank wall 12. As can be seen in FIGS. 3, 4 and 5, as water is heated by a heater 100 positioned below the preheat chamber 74, due to convection principles, hot water rises and cold water moves down (flow patterns of water being shown by arrows in the figures). The baffle 24 inhibits flow of hot water into the upper water reservoir. A limited amount of hot water does tend to flow into the upper reservoir through the perimeter positioned orifices 76,76' or open portions 75. This creates a dual convection system (ie. two separate flow patterns in each part of the tank).

Figure 11J:
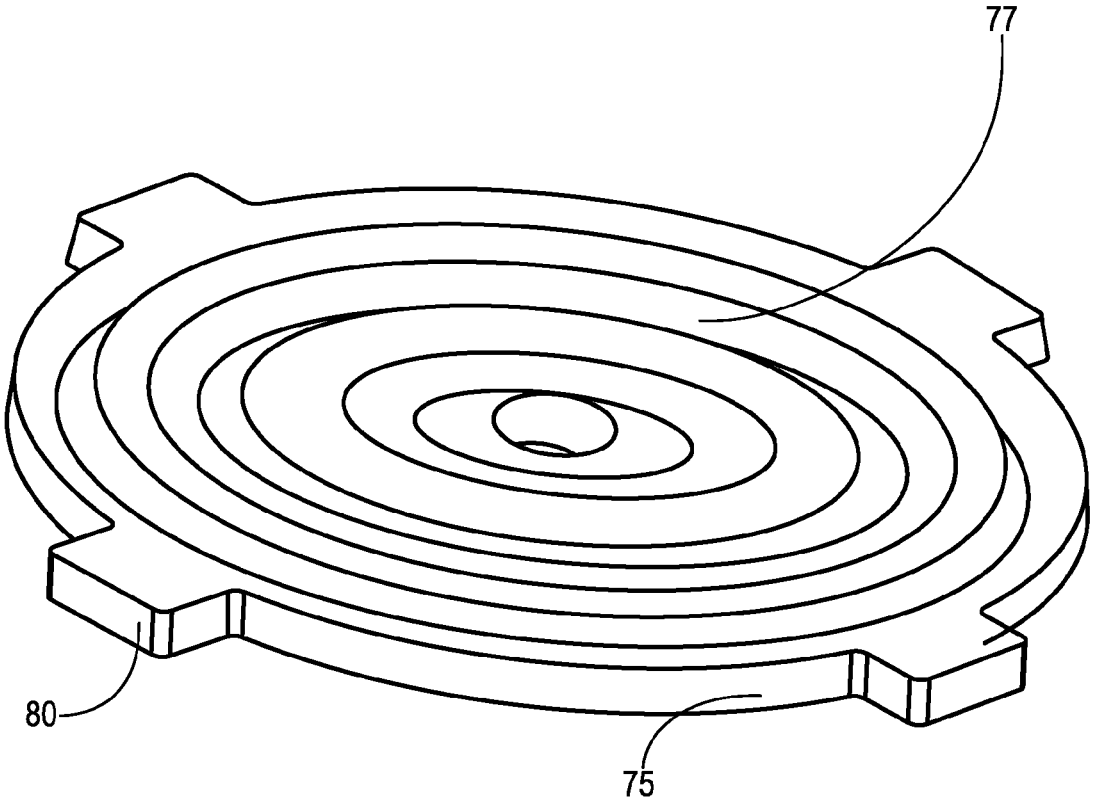
FIG. 11J is a perspective view of a further embodiment of a baffle in accordance with the invention.

When the hot water outlet tap is opened (not shown), hot water is dispensed through the outlet 18, due to pressure from the incoming cold water through the inlet pipe 16, 16' or 30/32 to the lower chamber. When cold water prompts the thermostat (as will be discussed below) to start the heating element 62, cold water in the heating chamber is heated, starting the first convection cycle in the heating chamber sending hot water up to the baffle and cold water down to the bottom wall of the tank (see FIGS. 3 to 5). Hot water existing in the main upper reservoir is not disturbed by the activity in the heating chamber. Heat is transferred to the water in the upper reservoir in two manners. Firstly, heat is transferred through the baffle 24, which is preferably comprised of stainless steel or any food grade high temperature resistant material. Secondly, hot water flows from the preheat chamber to the upper reservoir through the orifices 76 or open portions 75 positioned around the perimeter of the baffle. The total area of these orifices as a percentage of the total cross sectional area of the tank (ie. the surface area of the baffle if it completely separated the chambers) ranges from 5 to 70%. Shown in FIGS. 11A to 11J the various embodiments of baffles with differing orifice and open portion shapes and sizes. In embodiments shown in FIGS. 11I and 11J, the baffles include reinforcing ribs 77 extending in concentric circles around the center of the baffle. It should be understood that these embodiments of baffles and any other suitably shaped baffles could be utilized. In a preferred embodiment of the baffle, the baffle has open portions extending around the perimeter of the tank, having a width of 5 mm, these open portions, or orifices cover approximately 20% of the cross sectional area of the tank. It is preferred that the baffle is positioned within the tank approximately at a position ⅕ of the way up the tank from the bottom of the tank, although it could be positioned at any position along the length of the tank. In one embodiment, the baffle is positioned at 50 mm above the bottom wall of the tank. With the open portions or orifices covering 20% of the total baffle area, and the baffle at the above noted preferred position, the best combination of the low noise and water heating efficiency is observed.

The presence of the baffle provides the following advantages: with the cold water entering the preheat chamber, this prevents cold incoming water from mixing by natural convection forces with water in the upper reservoir and thereby reducing hot water temperature to be expelled through the outlet 18. By allowing flow of hot water from the preheat chamber 74 to the upper reservoir 72 through open portions 75 or perimeter orifices 76, 76', while preventing introduction of cold water directly into the main reservoir, the water temperature in the upper portion is not reduced as much as it would be without the baffle 24 by the newly introduced cold water.

In embodiments of the tank with an inlet pipe 16 extending through the middle of the tank, the baffle 24 may include a centrally positioned opening to accommodate the inlet pipe may be secured within the tank by welding it to the inlet pipe, with its legs 80 fit against the walls 12 of the tank.

Figure 14:
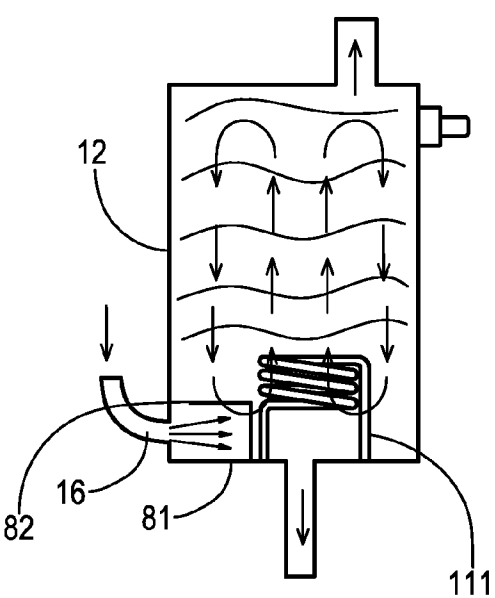
FIG. 14 (PRIOR ART)
FIG. 14 is a sectioned schematic view of a water tank illustrating the use of a prior art water inlet deflector with a water tank.
Figure 13:
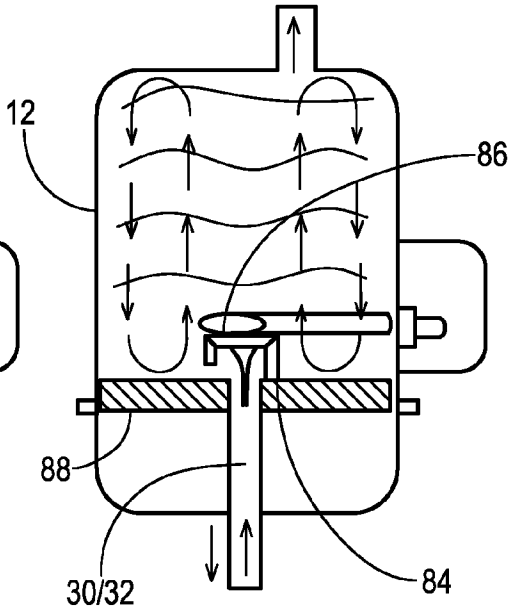
FIG. 13 is a sectioned schematic view of a water tank illustrating the use of a water inlet deflector in accordance with the invention.
Figure 12:
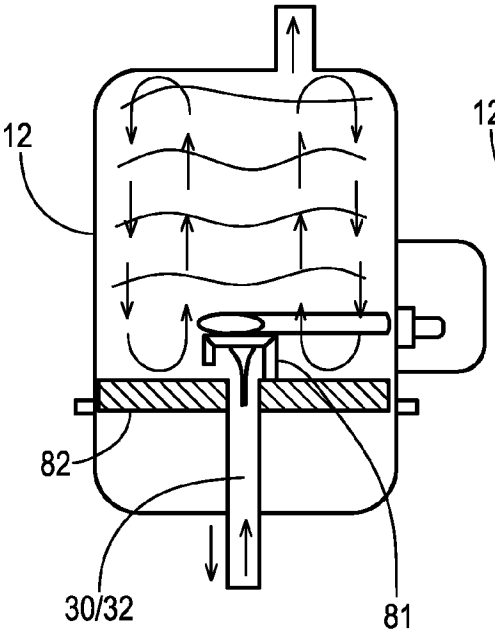
FIG. 12 is a sectioned schematic view of a water tank illustrating the use of a water inlet deflector with a water tank.
Figure 13A:
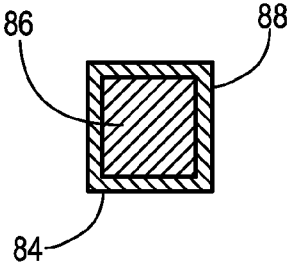
FIG. 13A is a bottom view of a water inlet deflector in accordance with the invention.

An aspect of the invention is an improvement on a deflector of cold water entering the tank. Shown in FIGS. 12 and 14, prior art water deflectors 81 which are positioned adjacent the inlet 16' or inlet/drain 30 typical comprise a flat piece 82 which acts to disperse the cold water entering the tank from the inlet pipe 12 or inlet/drain pipe 30/32. The improved deflector of the invention is secured to the tank wall 14 at a position adjacent the inlet. It has a first portion 84 extending into the tank and a planar or concave portion 86 extending across the flow of water, the planar or concave portion 86 having angled flange sections 88, angled toward the water source, extending around its perimeter. These downward flanges cause further dispersion of the water than is provided by the planar deflectors of the prior art Incidentally, please note that FIG. 14 illustrates the use of a heating element 111 directly within the water, while FIGS. 12 and 13 illustrate bottom mounted heating means 100.

Preferably the tank includes a thermostat 90 having temperature sensor means 92 positioned on the tank wall or within the tank in communication with means for powering of the heating element when the sensor measures a temperature at or below a predetermined temperature. The tank may also include a upper limit sensor positioned adjacent the heater 100 which shuts off said the heating element when the sensor reaches a predetermined upper temperature, which is preferably 130 degrees Celsius.

A preferred thermostat utilized in accordance with the invention is a bimetal type thermostat mounted on the outside of the hot water tank. An example is a disc type thermostat such as the Foshan Tangbao KDS 301 series thermostat. Other types of bi-metal thermostats known in the art can also be used.

When using thermostats mounted on the outside of the tank, it is commonly observed that the temperature read by the sensors is lower than the actual water temperature. As cold water flows into the tank, only when the temperature at the position of the thermostat goes below the set temperature is when thermostat is activated to commence heating. With the thermostat positioned at the top of the tank, due to convection flow, hot water will be at the top of the tank with cooler water below the thermostat. As hot water is drawn out, water above the thermostat will be hotter than the rating of the thermostat and thus very little of water will be above this temperature, with the rest being cooler than the set temperature. Also at this position, when thermostat restarts, it needs to re-heat almost a full tank of the cooler water, due to the delayed sensing and action of the thermostat.

As the heater pushes water temperature up, there is a delay in the transfer of the heat from the water inside to the walls of the tank and from the walls to the thermostat itself. This delay might cause a discrepancy between the water temperature and the reading at the thermostat by as much as 20 degrees Celsius, if not more, meaning, that water in the tank could be at 97 C temperature (close to boiling and ready for dispensing), while thermostat is getting disconnected (contacts open) at 77 C. One factor which influences this discrepancy is the location of the thermostat. The higher up the tank, the higher the discrepancy. With a thermostat position high up on the tank, there is no immediate temperature difference reading, since water is being circulated by convection and temperature at top remains high, even when the tank is getting cooler. A high positioned thermostat senses only the top layer of hot water, while lower levels are cooled down below the thermostat rating. Other factors which influence this discrepancy are: wattage of the heater, (ie. the higher is the wattage, greater is the difference) and conductivity between the water and thermostat.

The majority of the hot water tanks have bi-metal thermostats rated to be activated for heating when water temperature is below BOC for water temperature regulating purposes. In the prior art, B5C is the highest rated thermostat used for the hot water tanks. Such thermostats are known to be mounted at the middle of the hot tank, or higher.

In accordance with an aspect of the invention, provided is a thermostat 90 positioned below the middle of the tank on the side walls of the tank. The positioning closer to the bottom of the tank, reduces the discrepancy between water temperature and thermostat temperature at all times, including when the water is cooling down. In a hot water tank which includes an external bottom heater, such as the brazed heater design discussed above, and which includes a baffle 24 creating a preheat chamber 74 and upper water reservoir 72 as described above, the water in the pre-heating chamber will have a higher temperature that the water in the upper reservoir. In accordance with the invention, preferably used is an BBC or higher rated thermostats for this application with the thermostat positioned below the baffle on the wall of the tank. In one example, a 93C thermostat is positioned below the baffle in a 1.5 L tank.

In a tank design without the baffle, the thermostat is mounted below the middle of the tank. In fact, it would be expected that lower the thermostat is mounted, the better it works. It allows for the use of higher rated thermostat, higher restart temperature and therefore earlier start up when cold water enters the hot tank and reduction of the thermostat differential due to the layering of the cold and hot water. For the tanks without the baffle, with location of the thermostat lower than the mid point of the tank, 86C to 89C rated thermostats may be utilized.

It should be understood that any known type of thermostat could be utilized, including thermostats in which the sensor introduced directly in the water with the assistance of a steel sleeve.

Finally, it is to be understood that although one or more embodiments of the present invention have been herein shown and described, it will be understood that various changes in size and shape of parts may be made. For example, although certain heat conductive materials, such as stainless steel, aluminum, utilized for the tank and heating plates, any suitable heat conductive material could be utilized for these materials, such as brass, copper, and iron or the like: Any suitable thermostat should be utilized. Although the preferred manner of securing the elements of the heating unit together are by means of brazing it should be understood that these elements may be secured by welding or soldering them, together or by other mechanical means. It will be evident that these modifications, and others which may be obvious to persons of ordinary skill in the art, may be made without departing from the spirit or scope of the invention, which is accordingly limited only by the claims appended hereto, purposively construed.

The invention claimed is:

1. An apparatus for retaining and heating water comprising:

a tank for retaining water, said tank defined by tank walls, including a bottom wall portion comprised of heat conductive material and having a lower surface, the tank having a water inlet for receiving water and a water outlet for dispensing hot water;

an intermediate plate comprised of heat conductive material brazed to the lower surface of said bottom wall portion;

a heating element secured within a heat conductive sheath, said sheath brazed to and positioned below the intermediate plate for provision of heat thereto and by conduction to said bottom wall portion and the water retained in said tank, the heat conductive sheath has a trapezoidal cross section and is formed into an overall circular shape with a first and a second terminal seal filing ends of the heat conductive sheath and two terminal pins welded to resistance wire of the heating element the resistance wire extending outside each terminal pin, the intermediate plate is brazed over its entire surface area to the lower surface of the bottom wall and said sheath is brazed to the intermediate plate.

2. An apparatus as recited in claim 1 wherein said tank walls are comprised of stainless steel.

3. An apparatus as recited in claim 1 wherein said intermediate plate is comprised of aluminum.

4. An apparatus as recited in claim 1 wherein said heat conductive sheath is an aluminum tube.

5. An apparatus as recited in claim 1 wherein said intermediate plate has a thickness in the range of 3 mm to 9 mm.

6. An apparatus as recited in claim 1 wherein said intermediate plate is 3 mm thick.

7. An apparatus as recited in claim 1 wherein an insulation cover is secured to the tank, over the sheath and intermediate plate, restricting the dissemination of heat, except through the tank wall.

8. An apparatus as recited in claim 1 wherein said cover is a stainless steel or cast iron jacket.

9. An apparatus as recited in claim 1 wherein a baffle is positioned within the tank, extending across the interior of the tank, the baffle creating an upper water reservoir and a lower preheating chamber within the tank, the water inlet delivering water into the preheating chamber and the water outlet positioned at an upper portion of the upper water reservoir, said baffle having at least one open portion therethough to allow flow of water between the preheat chamber and the upper reservoir.

10. An apparatus as recited in claim 1 further comprising a thermostat including temperature sensing means, said thermostat positioned on the side wall of the tank, and which activates the heating element to provide heat to the tank when the thermostat reads a temperature at or below a preset temperature, the thermostat positioned on the tank wall below the baffle.

11. An apparatus for retaining and heating water comprising:

a tank for retaining water, said tank defined by tank walls, including a bottom wall portion comprised of heat conductive material and having a lower surface, the tank having a water inlet for receiving water and a water outlet for dispensing hot water;

an intermediate plate comprised of heat conductive material brazed to the lower surface of said bottom wall portion;

a heating element secured within a heat conductive sheath, said sheath brazed to and positioned below the intermediate plate for provision of heat thereto and by conduction to said bottom wall portion and the water retained in said tank, the heat conductive sheath has a trapezoidal cross section and is formed into an overall circular shape with a first and a second terminal seal filing ends of the heat conductive sheath and two terminal pins welded to resistance wire of the heating element the resistance wire extending outside each terminal pin, the intermediate plate is brazed over its entire surface area to the lower surface of the bottom wall and said sheath is brazed to the intermediate plate;

a baffle positioned within the walls of the tank, extending across the interior of the tank dividing the tank into an upper water reservoir and a lower preheating chamber; and said baffle defining a plurality of regularly spaced open portions positioned around the circumference of the baffle which allow circumferential flow of hot water from the preheat chamber to the upper water reservoir.

12. An apparatus as recited in claim 11 wherein said regularly spaced open portions are elongate slot shaped, each extending around the perimeter of the baffle adjacent the tank side walls.

13. An apparatus as recited in claim 11 wherein said open portions are positioned around the periphery of the baffle, between legs of the baffle, said legs extending outwardly from the baffle engaging the wall of tank, said open portions forming a gap between the tank wall and the baffle to allow water to flow between the water reservoir and preheat chamber.

14. An apparatus as recited in claim 11 wherein said open portions cover between 5 to 70% of the surface area of the baffle.

15. An apparatus as recited in claim 11 wherein said open portions cover 20% of the surface area of baffle.

16. An apparatus as recited in claim 11 wherein the heater comprises a heating element contained in an aluminum sheath, and an intermediate aluminum plate secured between the sheath and bottom wall.

17. An apparatus as recited in claim 11 wherein said sheath is brazed to the intermediate plate and said intermediate plate is brazed to the bottom wall, said bottom wall comprised of stainless steel.

18. An apparatus as recited in claim 11 wherein a cover is secured over the heating element and intermediate plate, restricting the dissemination of heat, except through the tank wall.

19. An apparatus as recited in claim 11 wherein the tank further includes an inlet delivering water into the preheat chamber and outlet positioned at an upper portion of the tank for dispensing of hot water therefrom.

20. An apparatus as recited in claim 11 further comprising a thermostat including temperature sensing means, said thermostat positioned on the side wall of the tank, and which activates the heating element to provide heat to the tank when the thermostat reads a temperature at or below a preset temperature, the thermostat positioned on the tank wall below the position of the baffle.

21. An apparatus as recited in claim 11, wherein said intermediate plate has a thickness is in the range of 3 mm to 9 mm.

* * * * *